US007785128B2

(12) United States Patent
Ito et al.

(10) Patent No.: US 7,785,128 B2
(45) Date of Patent: Aug. 31, 2010

(54) CONNECTOR

(75) Inventors: Yoshitaka Ito, Shizuoka (JP); Shinji Kodama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 113 days.

(21) Appl. No.: 12/292,515

(22) Filed: Nov. 20, 2008

(65) Prior Publication Data

US 2009/0149052 A1 Jun. 11, 2009

(30) Foreign Application Priority Data

Dec. 5, 2007 (JP) ..... 2007-314494

(51) Int. Cl.
*H01R 13/627* (2006.01)

(52) U.S. Cl. ..... 439/352

(58) Field of Classification Search ..... 439/345, 439/352, 357, 358, 595, 752, 310
See application file for complete search history.

(56) References Cited

U.S. PATENT DOCUMENTS 4,582,378 A * 4/1986 Fruchard ..... 439/157
5,154,630 A * 10/1992 Kamono et al. ..... 439/352
5,330,366 A * 7/1994 Tsuji et al. ..... 439/352
6,004,153 A * 12/1999 Myer et al. ..... 439/352
6,083,042 A * 7/2000 Kodama ..... 439/567
6,261,115 B1 * 7/2001 Pederson et al. ..... 439/352
6,287,609 B1 * 9/2001 Marlett et al. ..... 424/738
6,419,515 B1 * 7/2002 Okayasu ..... 439/358
7,114,983 B2 * 10/2006 Fukatsu et al. ..... 439/358
7,201,599 B2 * 4/2007 Holub ..... 439/357
7,387,545 B2 * 6/2008 Tyler et al. ..... 439/752
2001/0027058 A1 * 10/2001 Pederson et al. ..... 439/595
2005/0176298 A1 * 8/2005 Flowers et al. ..... 439/595

FOREIGN PATENT DOCUMENTS

JP 07-220798 8/1995

* cited by examiner

*Primary Examiner*—Alexander Gilman
(74) *Attorney, Agent, or Firm*—Edwards Angell Palmer & Dodge LLP

(57) ABSTRACT

The connector including the first and second connector housings is provided with means for draining water entered inside. At an end part of the second connector housing, situated at the front of an insertion direction of the first connector housing into the second connector housing, the second connector housing includes: a connecting part which connects a tube part and a body part of the second connector housing to each other; and a through hole which is adjacent to the connecting part and penetrates through the tube part to communicate a first space, which is outside the body part and inside the tube part, and the outside of the tube part to each other, wherein a facing surface of the connecting part facing the first connector housing is provided with an inclined surface gradually inclining toward the insertion direction as the facing surface approaches the through hole.

2 Claims, 6 Drawing Sheets

CONNECTOR

BACKGROUND OF THE INVENTION (1) Field of the Invention

The present invention relates to a connector for use in connection of electric wires and particularly to a connector including a drain means for draining water entered inside.

(2) Description of the Related Art

Various electronic instruments are mounted on a motor vehicle as a mobile unit. A wiring harness is arranged in the motor vehicle to transmit electric power and control signals to the electronic instruments. The electronic instrument and the wiring harness are connected to each other when connectors thereof are fitted to one another.

The connector includes a connector housing and terminal fittings to be received in the connector housing. When the connectors are fitted to each other, the terminal fittings in the respective connector housings are electrically connected to one another.

As for the connector described above, a simple waterproof connector (see Japanese Patent Application Laid-Open No. H7-220798) has been proposed as a connector to be used at a place where water is poured such as a place in an engine room. The simple waterproof connector includes a male connector housing (hereinafter, male housing) and a female connector housing (hereinafter, female housing) to be fitted to the male housing.

The male housing includes a terminal-receiving part for receiving a male terminal fitting and a tube-shaped male hood part which continues to the terminal-receiving part. The female housing includes a body part for receiving a female terminal fitting and a tube-shaped female hood part which is formed outside the body part and spaced from the body part. The body part of the female housing is received in the male hood part of the male housing and the male hood part of the male housing is inserted in between the female hood part and the body part of the female housing, thereby the male housing and the female housing are fitted to each other.

The simple waterproof connector described above includes: a flow gap having an enough gap distance to allow liquid such as water to flow therethrough so as not to be suffered from a capillary phenomenon, which might otherwise occur between an outer surface of the body part of the female housing and an inner surface of the hood part of the male housing; and drain holes to drain away liquid such as water entered inside the hood part of the male housing.

A plurality of the drain holes are provided on a terminal-receiving part-side end of the male hood part of the male housing and on an end of the female hood part of the female housing situated away from the male housing. The former drain holes pass through the male hood part of the male housing so as to communicate the inside and the outside to each other, while the latter drain holes pass through the female hood part of the female housing so as to communicate a space, which is inside the female hood part and outside the body part, and the outside of the female housing to each other.

The simple waterproof connector described above prevents liquid such as water from adhering on the terminal fitting and so on by draining liquid such as water entered from the drain hole after flowing down through the flow gap even when liquid such as water enters the inside of the male hood part of the male housing due to occurrence of condensation and so on.

However, the simple waterproof connector described above has a problem that when a side surface of the body part of the female housing is provided with a restricting member-receiving part, into which a restricting member for preventing the female terminal received in the body part of the female housing from coming out is inserted, there is a possibility that liquid such as water enters the body part from the restricting member-receiving part, causing a problem that the liquid such as water entered the body part of the female housing might adhere on the terminal fitting and so on.

SUMMARY OF THE INVENTION

It is therefore an objective of the present invention to solve the above problem and to provide a connector, which prevents liquid such as water from entering the body part that receives the terminal fitting therein so that the liquid such as water is prevented from adhering on the terminal fitting and so on.

In order to attain the above objective, the present invention is to provide a connector including:

a first connector housing having a tube-shaped hood part; and a second connector housing having a tube part and a body part which is received in the tube part and receives a terminal fitting therein, wherein the hood part of the first connector housing, which approaches the second connector housing from above, is inserted in the tube part of the second connector housing and the body part of the second connector housing is positioned in the hood part of the first connector housing, so that the first and second connector housings are fitted to each other, wherein at an end part of the second connector housing, said end part being situated at the front of an insertion direction of the first connector housing into the second connector housing, the second connector housing includes:

a connecting part which connects the tube part and the body part to each other; and a through hole which is adjacent to the connecting part and penetrates through the tube part so as to communicate a first space, which is outside the body part and inside the tube part, and the outside of the tube part to each other, wherein a facing surface of the connecting part facing the first connector housing is provided with an inclined surface gradually inclining toward the insertion direction of the first connector housing as the facing surface approaches the through hole.

With the construction described above, when liquid such as water enters from between the hood part of the first connector housing and the tube part of the second connector housing, the liquid such as water can be smoothly drained from the through hole to the outside. Therefore, the liquid such as water can be prevented from entering in between the hood part of the first connector housing and the body part of the second connector housing. Accordingly, the liquid such as water can be prevented from entering the body part, which receives the terminal fittings, and therefore, the liquid such as water can be prevented from adhering on the terminal fitting and so on.

A second space is formed between an end of the hood part and the connecting part when the first and second connector housings are fitted to each other.

With the construction described above, even when liquid such as water, which is entered in between the hood part of the first connector housing and the tube part of the second connector housing, is not fully drained and remains at the connecting part, the liquid such as water can be prevented from entering in between the hood part and the body part from an end part of the hood part. Accordingly, the liquid such as water can be securely prevented from entering the body part, which receives the terminal fittings, and therefore, the liquid such as water can be securely prevented from adhering on the terminal fitting and so on.

DESCRIPTION OF THE PREFERRED EMBODIMENTS

Figure 1:
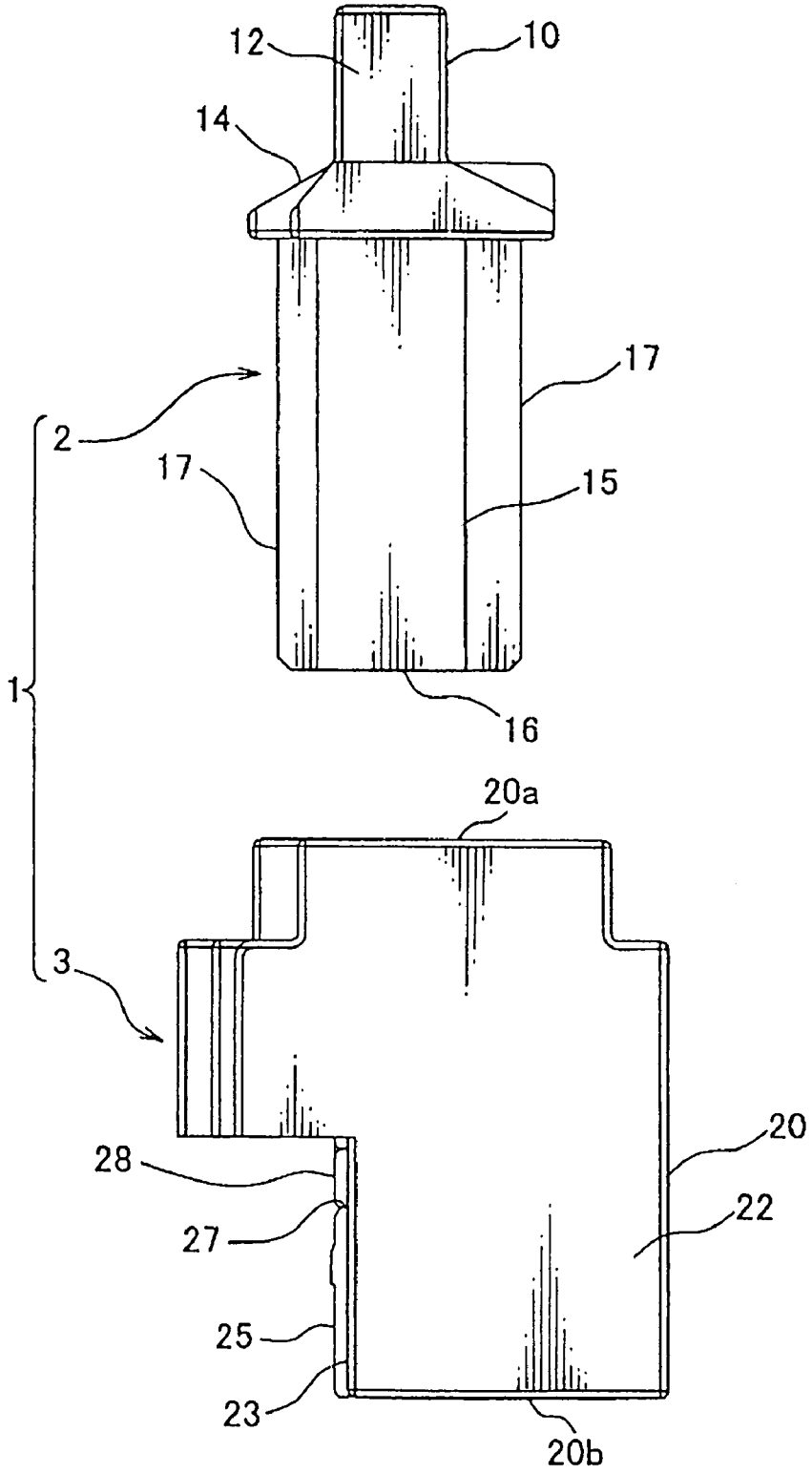
FIG. 1 is a side view illustrating a connector according to a preferred embodiment of the present invention.

In the following, a preferred embodiment of the present invention will be explained with reference to FIGS. 1-6. As shown in FIG. 1, a connector 1 according to the preferred embodiment of the present invention includes a male connector housing 2 (hereinafter, male housing 2) and a female connector housing 3 (hereinafter, female housing 3).

The male housing 2 corresponds to the first connector housing described above and the female housing 3 corresponds to the second connector housing described above.

Figure 2:
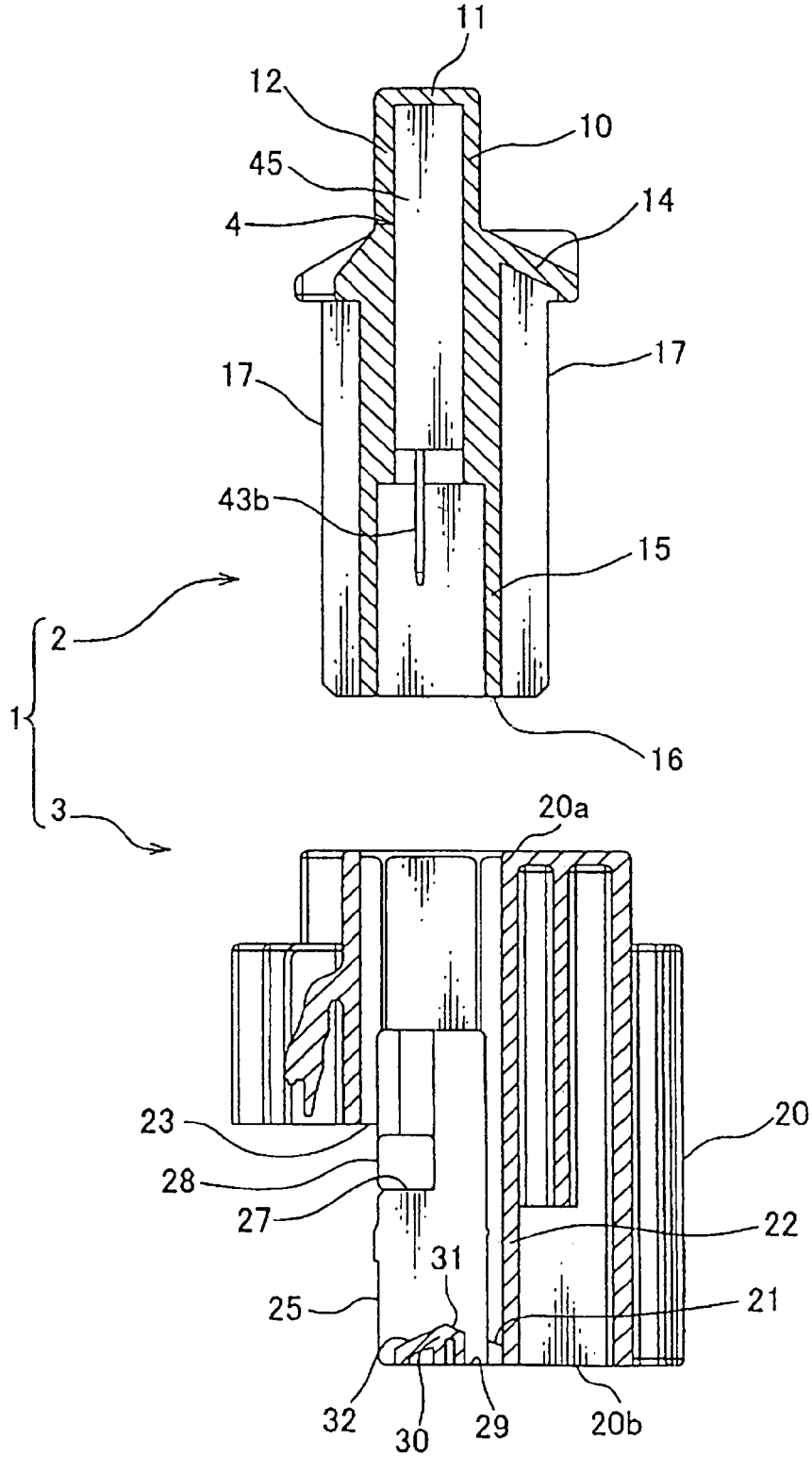
FIG. 2 is a view illustrating cross sections of male and female housings of the connector shown in FIG. 1.

The male housing 2 is made of electrically insulating synthetic resin or the like and as shown in FIG. 1, includes a receiving part 10 and a tube-shaped hood part 15 continuing to the receiving part 10. As shown in FIG. 2, the male housing 2 receives a switching unit 4 therein.

Figure 6:
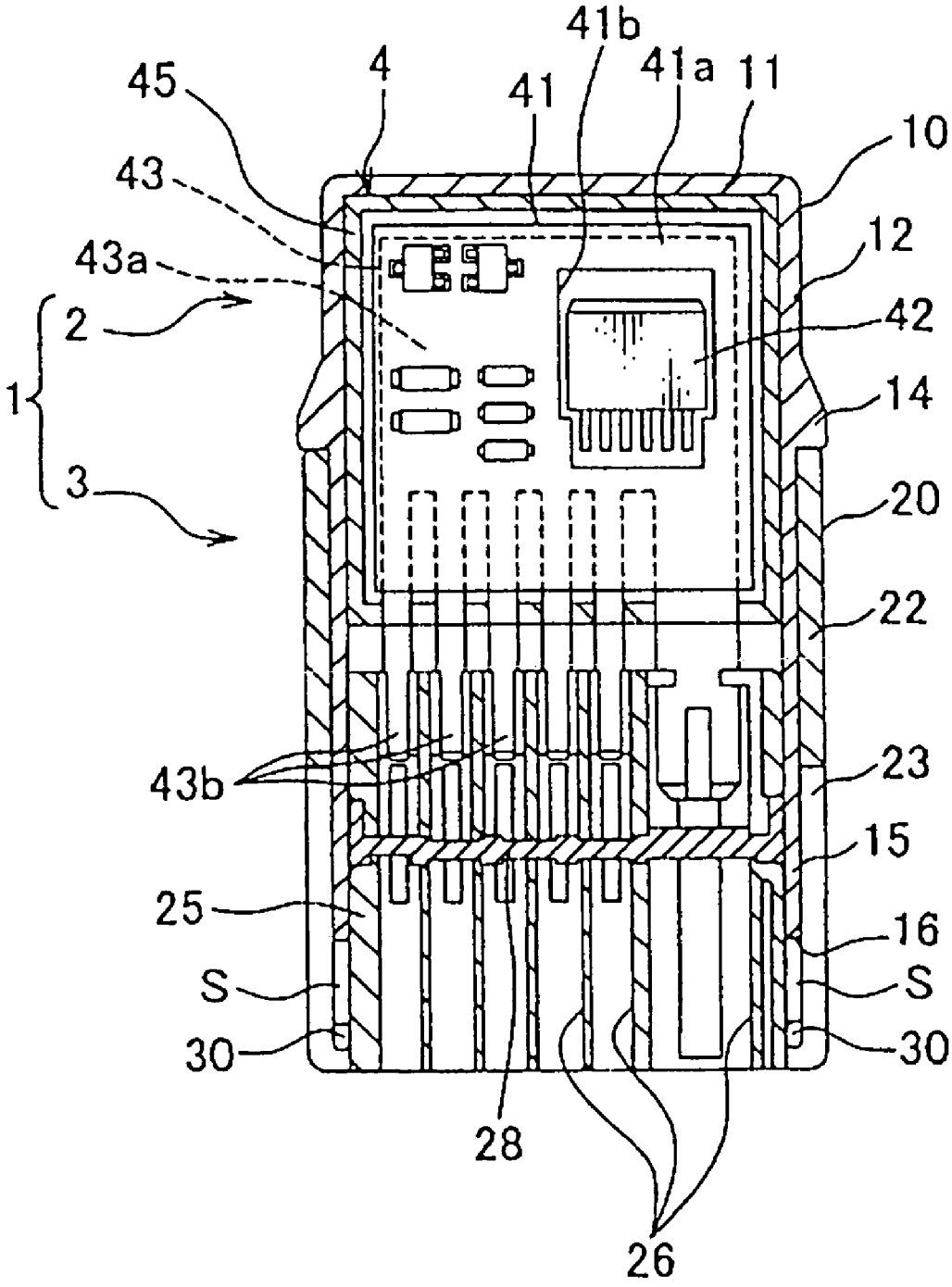
FIG. 6 is a cross sectional view taken along VI-VI line in FIG. 5.

As shown in FIG. 6, the switching unit 4 includes a unit body 40 and a resin sealing body 45 encircling the unit body 40. The unit body 40 includes a circuit board 41, a switching device 42 mounted on the circuit board 41, and a connecting terminal 43 which is attached to the circuit board 41 and connected to the switching device 42.

The circuit board 41 includes a substrate 41*a* made of electrically insulating synthetic resin and a conductor pattern (not shown in the figure) formed on a surface of the substrate 41*a*. The substrate 41*a* is formed in a flat rectangular shaped plate and provided with a through hole 41*b* formed penetrating through the substrate 41*a*. The substrate 41*a* mounts the switching device 42 and various electronic components (not shown in the figure). A terminal body part 43*a* (explained later) of the connecting terminal 43 is placed on a back surface of the substrate 41*a*.

The conductor pattern consists of metal such as copper and is formed in a foil-shape (i.e. thin film-shape) and stuck on the surface of the substrate 41*a*. The conductor pattern is formed according to a predetermined pattern for electrically connecting the switching device 42 and the electronic components with each other.

The switching device 42 controls turning on and turning off of a current. In the preferred embodiment, the switching device 42 is a semiconductor switching element in which a power MOSFET part and a control part having an overheat-protection function and PMW signal oscillation function are arranged on one chip. The switching device 42 is electrically connected to the terminal body part 43*a* of the connecting terminal 43 through the through hole 41*b* formed in the substrate 41*a* of the circuit board 41 so as to be mounted on the circuit board 41.

The connecting terminal 43 is made of metal and includes integrally the terminal body part 43*a* and a plurality of male tabs 43*b*. The connecting terminal 43 is formed in a rectangular flat plate-shape in plan view. The connecting terminal 43 is placed on and attached to the back surface of the substrate 41*a*.

Each male tab 43*b* is formed in a bar-shape extending straight. The plurality of the male tabs 43*b* are arranged in parallel with each other having a distance therebetween. When the male housing 2 and the female housing 3 are fitted to each other, the plurality of the male tabs 43*b* enter the respective terminal-receiving chambers 26 (explained later) of the female housing 3 so as to be electrically mechanically connected to respective electrical contact parts of female terminals (not shown in the figure) received in the respective terminal-receiving chambers 26.

The resin sealing body 45 is made of synthetic resin or the like and formed in a flat box-shape. The resin sealing body 45 performs sealing by receiving the circuit board 41, switching device 42, terminal body part 43*a* of the connecting terminal 43 and base parts of the respective male tabs 43*b* near the terminal body part 43*a* in a mold for molding followed by the molding. That is, the resin sealing body 45 coats and receives the circuit board 41, switching device 42 and terminal body part 43*a* of the connecting terminal 43, and exposes the respective male tabs 43*b* of the connecting terminal 43 so as to seal the unit body 40.

As shown in FIG. 2, the receiving part 10 is formed in a tube-shape having a ceiling and includes a ceiling wall 11 and a peripheral wall 12 continuing to a peripheral edge of the ceiling wall 11. The receiving part 10 receives the switching unit 4 therein. The receiving part 10 includes a flange part 14 and a locking part (not shown in the figure).

The flange part 14 projects toward the outside from the peripheral wall 12 and is formed along an outer circumference of the peripheral wall 12. The flange part 14 is arranged at a position where the flange part 14 abuts against an upper end part 20*a* of a tube part 20 (explained later) of the female housing 3 when the male housing 2 and the female housing 3 are fitted to each other. The locking part fits to a lock-receiving part formed on the tube part 20 of the female housing 3 so as to make the male housing 2 and the female housing 3 fitted to each other.

The hood part 15 is formed in a tube-shape continuing to the peripheral wall 12 of the receiving part 10. The hood part 15 is opened on an outer surface of the hood part 15, that is, an outer surface of the male housing 2 at the side away from the receiving part 10, that is, at the side of a front end 16 of an insertion direction of the male housing 2 into the female housing 3. The hood part 15 receives a body part 25 (explained later) of the female housing 3 therein and is received in the tube part 20 of the female housing 3. The hood part 15 includes a guide rib 17.

A plurality of the guide ribs 17 are formed projecting from an outer surface of the hood part 15. Each guide rib 17 is formed in a square pillar-shape extending straight toward the front end 16 of the hood part 15 from the flange part 14. Each guide rib 17 extends along the insertion direction in which the hood part 15 is inserted into the tube part 20 of the female housing 3, that is, along a fitting direction of the male housing 2 and the female housing 3.

Here, the fitting direction is a direction in which the male housing 2 and the female housing 3 approach each other when the male housing 2 and the female housing 3 are being fitted to each other and is parallel to the vertical direction. In an example shown in the figure, the fitting direction is parallel to a longitudinal direction of the male tab 43*b* of the connecting terminal 43 of the switching unit 4 disposed in the male housing 2, to a longitudinal direction of a female terminal (explained later) disposed in the female housing 3, and to a longitudinal direction of an electric wire to be attached to the connecting terminal 43 and the female terminal.

The female housing 3 is made of electrically insulating synthetic resin or the like. As shown in FIG. 1, the female housing 3 includes: the tube part 20; the body part 25 which is received in the tube part 20 and formed in a box-shape; a restricting member 28 which is attached to the body part 25 and prevents the female terminal from coming out from the body part 25; and a connecting part 30 which connects the tube part 20 and the body part 25 to each other.

Figure 3:
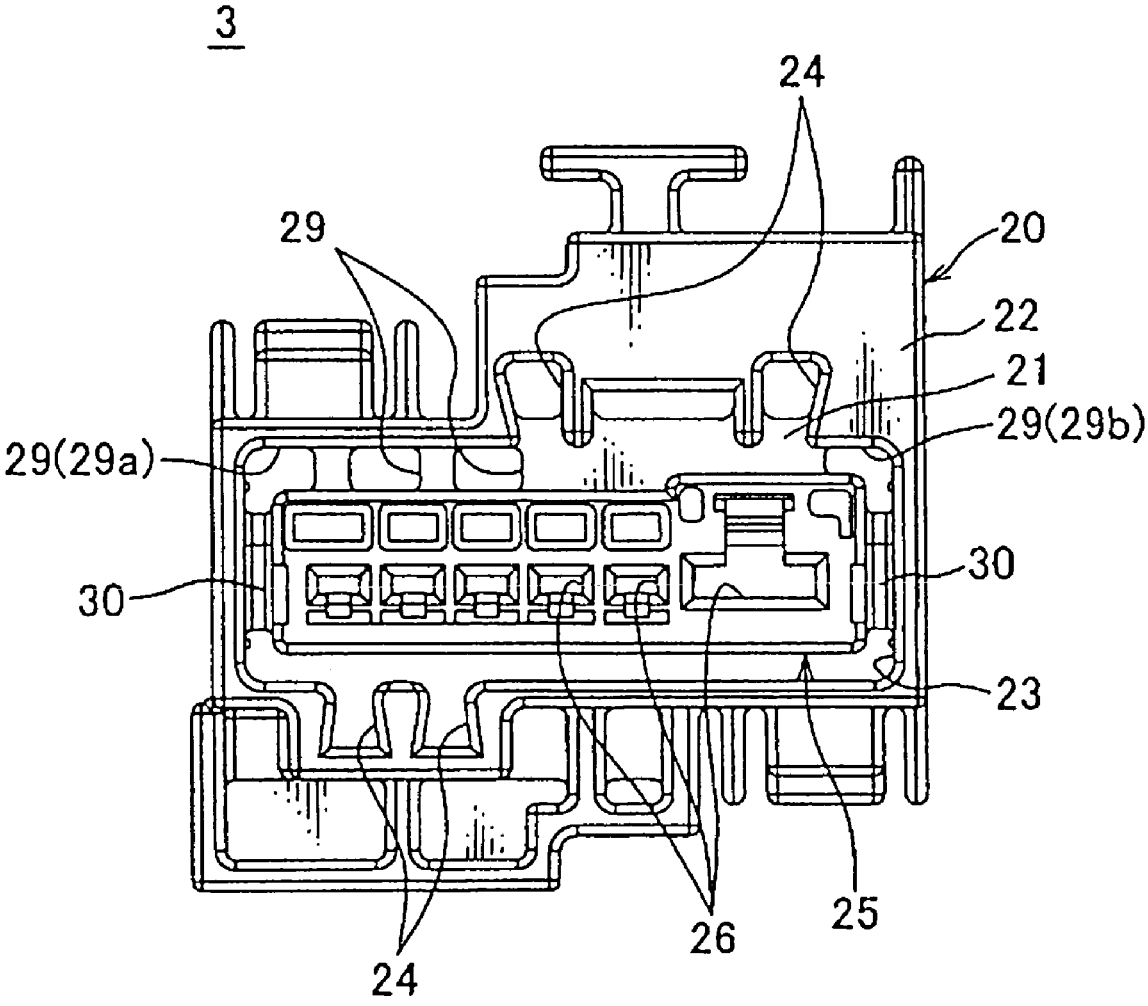
FIG. 3 is a plan view, viewed from above, of the female housing of the connector shown in FIG. 1.

As shown in FIGS. 2 and 3, the tube part 20 is formed in a tube-shape having a ceiling and includes a bottom wall 21 and a peripheral wall 22 continuing to a peripheral edge of the bottom wall 21. An upper end part 20*a* of the tube part 20, which is located away from the bottom wall 21 of the peripheral wall 22, is formed open on an outer surface of the tube part 20, that is, on an outer surface of the female housing 3. The tube part 20 receives the body part 25 therein. An inner surface of the peripheral wall 22 is placed being spaced from an outer surface of the body part 25. The hood part 15 of the male housing 2 is inserted into the tube part 20 of the female housing 3 from the side of the upper end part 20*a*, which is open on the outer surface of the female housing 3.

Further, the tube part 20 is provided with: an opening 23 formed by notching in an L-shape a part of the peripheral wall 22 so as to expose a part of an outer surface of the body part 25 received in the tube part; and a plurality of openings 29 formed penetrating through the bottom wall 21. The opening 23 is arranged on the side of the bottom wall 21 of the peripheral wall 22, that is, on the side of a lower end part 20*b*, which faces oppositely the upper end part 20*a* of the tube part 20 in the fitting direction of the male housing 2 and the female housing 3. The opening 23 penetrates through the peripheral wall 22 of the tube part 20 so as to communicate a space, which is outside the body part 25 and inside the tube part 20, and the outside of the tube part 20 to each other.

The plurality of the openings 29 are arranged along a direction, in which the terminal-receiving chambers 26 of the body part 25 are lined up, having a distance therebetween. Each opening 29 communicates a space, which is outside the body part 25 and inside the tube part 20, and the outside of the tube part 20 to each other. The opening 23 and the plurality of the openings 29 correspond to the through holes.

Further, the tube part 20 is provided with a lock-receiving part (not shown in the figure), to which the locking part described above fits, and a guide groove 24, into which the guide rib 17 enters.

As shown in FIG. 3, a plurality of the guide grooves 24 are formed depressed from an inner surface of the peripheral wall 22 of the tube part 20. Each guide groove 24 is formed from the upper end part 20*a* to the lower end part 20*b* of the peripheral wall 22 of the tube part 20. That is, each guide groove 24 extends in the direction in which the hood part 15 of the male housing 2 is inserted into the tube part 20, that is, in the fitting direction of the male housing 2 and the female housing 3. When the guide rib 17 of the male housing 2 enters the corresponding guide groove 24, the male housing 2 and the female housing 3 are fitted to each other in a correct direction.

As shown in FIG. 3, the body part 25 is formed in a box-shape and includes the plurality of the terminal-receiving chambers 26 arranged parallel with each other. In the body part 25, each female terminal fitting (hereinafter, female terminal) attached to an end of an electric wire are received in a corresponding terminal-receiving chamber 26. Further, the body part 25 is provided with a restricting member-receiving part 27 which receives the restricting member 28 therein.

Each terminal-receiving chamber 26 is a straight space formed in the body part 25. A longitudinal direction of the terminal-receiving chamber 26 is parallel to the fitting direction of the male housing 2 and the female housing 3. Both ends of each terminal-receiving chamber 26 in the longitudinal direction thereof are opened on an outer surface of the body part 25. The plurality of the terminal-receiving chambers 26 are arranged in parallel with each other. An inner surface of the terminal-receiving chamber 26 is provided with a locking lance (not shown in the figure) which has flexibility and locks the female terminal. The locking lance locks the female terminal so as to prevent the female terminal from coming out from the terminal-receiving chamber 26.

The female terminals are made of metal. Each female terminal includes integrally a tube-shaped electric contact part and an electric wire-connecting part continuing to the electric contact part. A male tab 43*b* of the connecting terminal 43 described above enters the inside of the electric contact part so as to be electrically mechanically connected to the electric contact part. The electric contact part attaches an electric wire (not shown in the figure) thereto so as to be electrically connected to a core wire of the electric wire. When the male housing 2 and the female housing 3 are fitted to each other, the male tab 43*b* of the connecting terminal 43 enters the inside of the electric contact part so as to electrically connect the electric wire and the connecting terminal 43 to each other.

As shown in FIGS. 1, 2 and 6, the restricting member-receiving part 27 is provided on a side surface of the body part 25 exposed from the opening 23 of the tube part 20. The restricting member-receiving part 27 is formed penetrating through an outer wall of the body part 25 to communicate with the terminal-receiving chamber 26. The restricting member-receiving part 27 is formed in a rectangular shape in plan view and extends along a direction in which the plurality of the terminal-receiving chambers 26 are lined up.

The restricting member 28 is made of electrically insulating synthetic resin or the like and as shown in FIGS. 2 and 6, formed in a square pillar-shape. The restricting member 28 enters the inside of the restricting member-receiving part 27 so as to be attached to the body part 25. When the restricting member 28 is received in the restricting member-receiving part 27, the restricting member 28 presses an inner surface of the terminal-receiving chamber 26 so as to prevent the female terminal from coming out from the terminal-receiving chamber 26.

The connecting part 30 is provided on the side of the lower end part 20*b* of the tube part 20 and connects an inner surface of the peripheral wall 22 of the tube part 20 and an outer surface of the body part 25 to each other. As shown in FIG. 3, a pair of the connecting parts 30 is provided between the side surfaces of the body part 25 facing each other in a direction, in which the terminal-receiving chambers 26 are lined up, and the corresponding inner surfaces of the peripheral wall 22 of the tube part 20 facing the corresponding side surfaces of the body part 25. The pair of the connecting parts 30 is provided adjacent to the opening 23 of the tube part 20.

The pair of the connecting parts 30 is adjacent to openings 29*a* and 29*b*, respectively, positioned at both ends of the plurality of the openings 29, which are lined up having a distance therebetween. Each connecting part 30 is provided with a plurality of tapered surfaces 31 and 32.

The plurality of the tapered surfaces 31 and 32 are provided on a surface of the connecting part 30 facing the male housing 2. That is, the plurality of the tapered surfaces 31 and 32 are provided on the connecting part 30 so as to be positioned in the tube part 20. One tapered surface 31 is provided on the opening 29-side of the connecting part 30 and gradually inclined toward the outside of the tube part 20 as approaching the opening 29 (i.e. as the one tapered surface 31 approaches the opening 29). That is, the one tapered surface 31 is gradually inclined toward the insertion direction of the hood part 15 of the male housing 2 as approaching the opening 29.

The other tapered surface 32 is provided on the opening 23-side of the connecting part 30 and gradually inclined toward the outside of the tube part 20 as approaching the opening 23. That is, the other tapered surface 32 is gradually inclined toward the insertion direction of the hood part 15 of the male housing 2 as approaching the opening 23. The plurality of the tapered surfaces 31 and 32 are the inclined surfaces as described above.

When the connector 1 having a structure described above is being assembled, first, the switching unit 4 having electric wires is received in the receiving part 10 of the male housing 2. Then, the female terminal having an electric wire is received in the terminal-receiving chamber 26 of the body part 25 of the female housing 3. At that time, the locking lance formed in the terminal-receiving chamber 26 locks the female terminal so as to prevent the female terminal from coming out from the terminal-receiving chamber 26.

Then, as shown in FIGS. 1 and 2, the restricting member 28 is inserted into the restricting member-receiving part 27 of the body part 25, in which the female terminal is received, and attached to the body part 25. Then, the restricting member 28 presses the male terminal, which is in the terminal-receiving chamber 26, onto an inner surface of the terminal-receiving chamber 26 so as to prevent the female terminal from coming out from the terminal-receiving chamber 26. That is, the female terminal received in the terminal-receiving chamber 26 is locked within the terminal-receiving chamber 26 by both of the locking lance and the restricting member 28.

Then, the male housing 2 and the female housing 3 are allowed to face each other in the vertical direction so that the male housing 2 is positioned above and the female housing 3 is positioned below. Then, the male housing 2 is allowed to approach the female housing 3 from above, so that the guide rib 17 formed on the hood part 15 of the male housing 2 enters the guide groove 24 formed on an inner surface of the peripheral wall 22 of the tube part 20 of the female housing 3 and the hood part 15 of the male housing 2 is inserted in between the tube part 20 and the body part 25 of the female housing 3.

Figure 4:
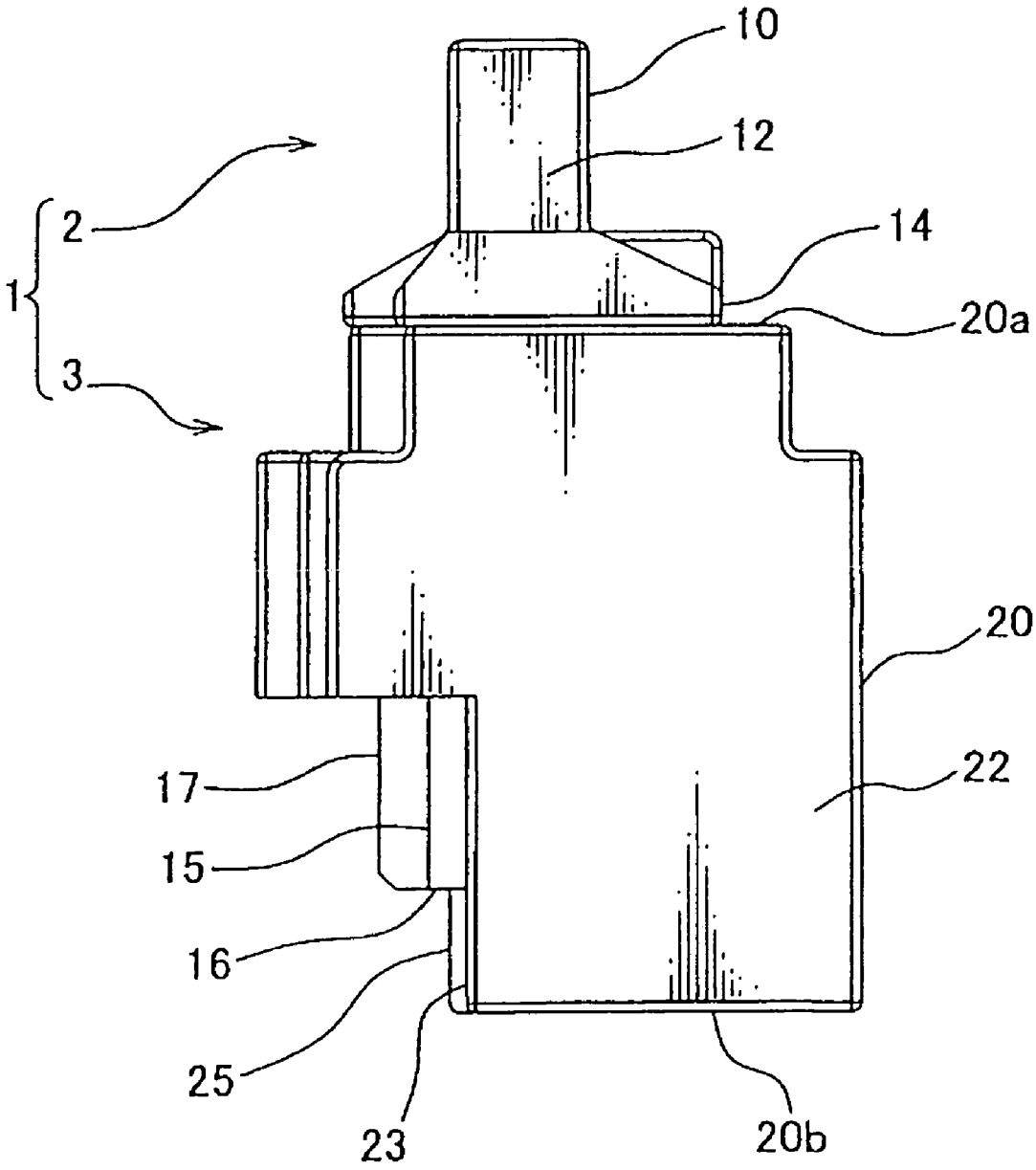
FIG. 4 is a side view illustrating a state when the male and female housings of the connector shown in FIG. 1 are fitted to each other.
Figure 5:
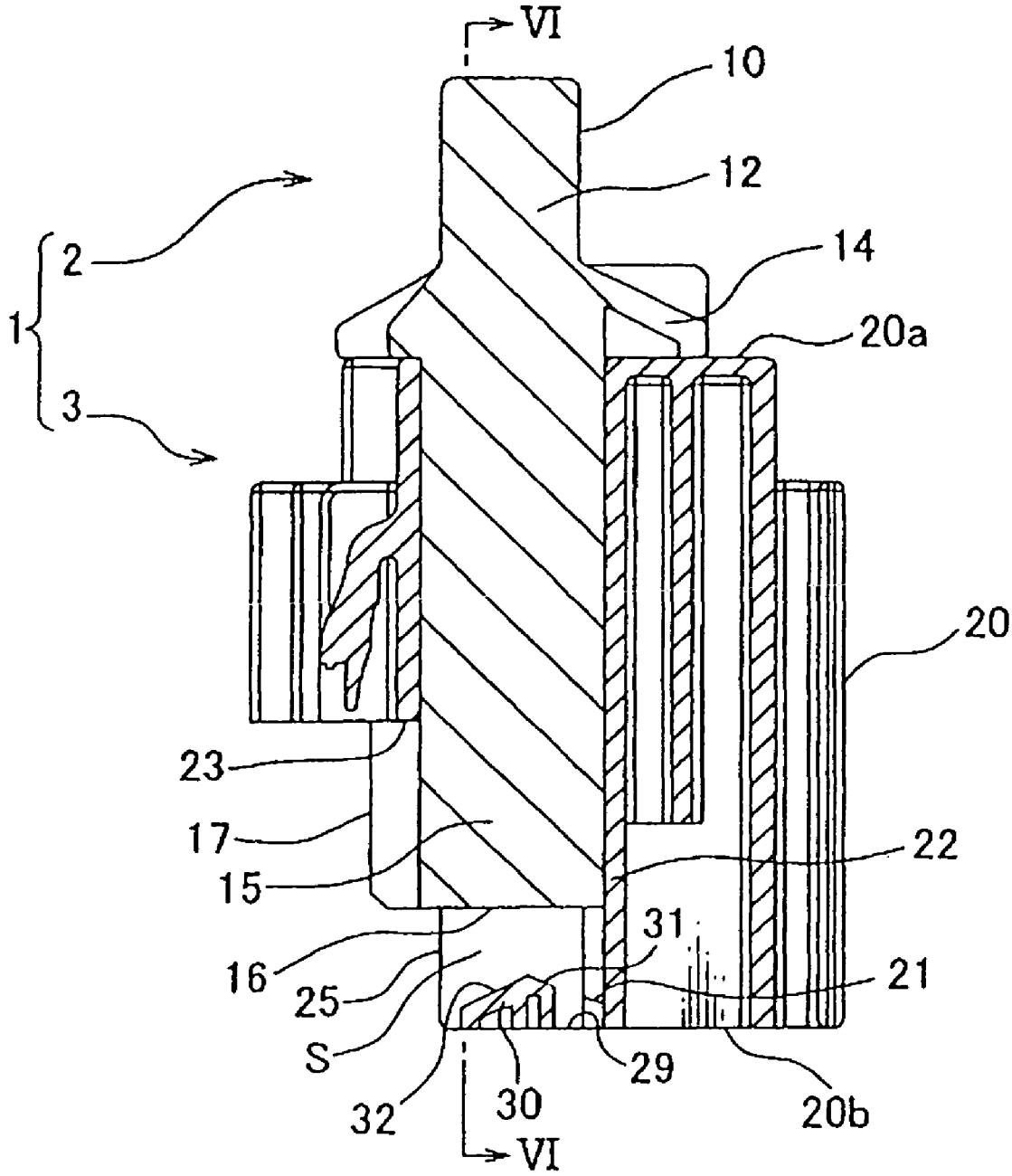
FIG. 5 is a view illustrating cross sections of the male and female housings shown in FIG. 4.

When the male housing 2 further approaches the female housing 3, as shown in FIGS. 4 and 5, the flange part 14, which projects from the peripheral wall 12 of the receiving part 10 of the male housing 2, abuts against the upper-end part 20*a* of the tube part 20 of the female housing 3, and the locking part (not shown in the figure), which is provided on the receiving part 10 of the male housing 2, fits to the lock-receiving part (not shown in the figure) provided on the tube part 20 of the female housing 3.

At that time, the male tab 43*b* of the connecting terminal 43 of the switching unit 4 received in the receiving part 10 of the male housing 2 enters into the electric contact part of the female terminal received in the terminal-receiving chamber 26 of the female housing 3, so that the connecting terminal 43 and the female terminal are electrically mechanically connected to each other. Thus, the male housing 2 and the female housing 3 are fitted to each other, so that the connector 1 is assembled.

When the male housing 2 and the female housing 3 are fitted to each other, the hood part 15 of the male housing 2 positions the body part 25 of the female housing 3 therein. As shown in FIGS. 5 and 6, the front end 16 of the hood part 15 of the male housing 2 is positioned between the tube part 20 and the body part 25 with having a distance between the front end part 16 and the bottom wall 21 of the tube part 20 of the female housing 3, so that a space S is formed between the front end 16 and the bottom wall 21. That is, the front end part 16 of the hood part 15 is spaced from the pair of the connecting parts 30, which is formed at the lower end part 20*b*-side of the tube part 20, and the space S is formed between the front end 16 and the pair of the connecting parts 30.

According to the preferred embodiment described above, the female housing 3 includes: the connecting parts 30 connecting the tube part 20 and the body part 25 to each other; and the openings 23, 29, which penetrate through the tube part 20 adjacent to the connecting part 30 and communicate the space, which is outside the body part 25 and is inside the tube part 20, and the outside of the tube part 20 to each other, at the lower end part 20*b* positioned on the front end 16-side of the tube part 20 of the female housing 3 in the insertion direction of the hood part 15 of the male housing 2, wherein a facing surface of the connecting part 30 facing the male housing 2 is provided with tapered surfaces 31, 32 gradually inclined toward the insertion direction of the hood part 15 of the male housing 2 as the facing surface approaches the opening 23 or 29.

Therefore, when liquid such as water enters from between the hood part 15 of the male housing 2 and the tube part 20 of the female housing 3, the liquid can be smoothly drained from the openings 23, 29, so that the liquid such as water can be prevented from entering in between the hood part 15 of the male housing 2 and the body part 25 of the female housing 3. That is, the liquid such as water can be prevented from entering the body part 25, which receives the female terminals connected to the respective male tabs 43*b* of the connecting terminals 43, so that the liquid such as water can be prevented from adhering on the male tab 43*b* of the connecting terminal 43, the female terminal and so on.

The space S is formed between the front end 16 of the hood part 15 of the male housing 2 and the connecting part 30 of the female housing 3 when the male housing 2 and the female housing 3 are fitted to each other.

Therefore, even when liquid such as water, which is entered in between the hood part 15 of the male housing 2 and the tube part 20 of the female housing 3, is not fully drained from the openings 23, 29 and remains at the connecting part 30, the liquid such as water can be prevented from entering in between the hood part 15 and the body part from the end 16 of the hood part 15. Accordingly, the liquid such as water can be securely prevented from entering the body part 25, which receives the female terminals connected to the respective male tabs 43*b* of the connecting terminals 43. Therefore, the liquid such as water can be securely prevented from adhering on the male tab 43*b* of the connecting terminal 43, the female terminal and so on.

The aforementioned preferred embodiments are described to aid in understanding the present invention and variations may be made by one skilled in the art without departing from the spirit and scope of the present invention.

What is claimed is:

1. A connector comprising:

a first connector housing having a tube-shaped hood part; and a second connector housing having a tube part and a body part which is received in the tube part and receives a terminal fitting therein, wherein the hood part of the first connector housing, which approaches the second connector housing from above, is inserted in the tube part of the second connector housing and the body part of the second connector housing is positioned in the hood part of the first connector housing, so that the first and second connector housings are fitted to each other, wherein at an end part of the second connector housing, said end part being situated at the front of an insertion direction of the first connector housing into the second connector housing, the second connector housing includes:

a connecting part which connects the tube part and the body part to each other; and a through hole which is adjacent to the connecting part and penetrates through the tube part so as to communicate a first space, which is outside the body part and inside the tube part, and the outside of the tube part to each other, wherein a facing surface of the connecting part facing the first connector housing is provided with an inclined surface gradually inclining toward the insertion direction of the first connector housing as the facing surface approaches the through hole.

2. The connector according to claim 1, wherein a second space is formed between an end of the hood part and the connecting part when the first and second connector housings are fitted to each other.

* * * * *